US008075357B2

(12) United States Patent
Fukuoka et al.

(10) Patent No.: US 8,075,357 B2
(45) Date of Patent: Dec. 13, 2011

(54) OUTBOARD MOTOR

(75) Inventors: Yoshihito Fukuoka, Shizuoka (JP); Daisuke Nakamura, Shizuoka (JP); Hirotoshi Yamauchi, Shizuoka (JP); Sachiyo Hasegawa, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 428 days.

(21) Appl. No.: 12/345,940

(22) Filed: Dec. 30, 2008

(65) Prior Publication Data

US 2009/0181585 A1 Jul. 16, 2009

(30) Foreign Application Priority Data

Jan. 11, 2008 (JP) ..... 2008-003974

(51) Int. Cl.
*B63H 20/00* (2006.01)

(52) U.S. Cl. ..... 440/88 L; 440/75

(58) Field of Classification Search ..... 440/75, 440/88 L, 88 R; 417/364; 475/312
See application file for complete search history.

(56) References Cited

U.S. PATENT DOCUMENTS

| | | | | |
|---|---|---|---|---|
| 5,643,025 | A * | 7/1997 | Suzuki | 440/75 |
| 7,182,658 | B2 * | 2/2007 | Asakaze et al. | 440/88 L |
| 7,704,183 | B2 * | 4/2010 | Nakamura et al. | 475/312 |
| 2008/0009207 | A1 * | 1/2008 | Okabe | 440/88 L |
| 2008/0070739 | A1 | 3/2008 | Nakamura et al. | |
| 2008/0233815 | A1 | 9/2008 | Nakamura et al. | |

FOREIGN PATENT DOCUMENTS

WO 2007/007707 A1 1/2007

* cited by examiner

*Primary Examiner* — Lars A Olson
(74) *Attorney, Agent, or Firm* — Keating & Bennett, LLP

(57) ABSTRACT

An oil supply device includes an axial oil passage and an intersecting oil passage provided in a propeller shaft, an axial oil passage and an intersecting oil passage provided in a drive shaft, and an oil guide passage. The intersecting oil passages allow oil inside the axial oil passages to be spouted radially of the shaft by centrifugal force generated as the shafts rotate. The oil is then supplied via the oil guide passage to an intermediate speed reduction device. As a result, it is possible to sufficiently lubricate an intermediate speed reduction device mounted on a drive shaft through a simple and compact arrangement.

11 Claims, 4 Drawing Sheets

OUTBOARD MOTOR

BACKGROUND OF THE INVENTION

1. Field of the Invention

The present invention relates to an oil supply device for an outboard motor that lubricates an intermediate speed reduction device provided on an intermediate portion of a drive shaft.

2. Description of the Related Art

WO 2007/007707 discloses an outboard motor having an engine installed in a vertical arrangement above a casing, with a drive gear provided at the lower end of a crankshaft of the engine and a driven gear provided at the upper end of a drive shaft extending downward inside the casing. In the outboard motor, the drive gear and the driven gear are meshed with each other in order to transmit the rotation of the crankshaft to the drive shaft.

Increasing the number of teeth of the drive gear relative to the driven gear allows the gears to serve as an intermediate speed reduction device, which reduces the rotation of the crankshaft before being transmitted to the drive shaft.

The gear transmission mechanism (intermediate speed reduction device) disclosed in WO 2007/007707 is provided immediately below the engine, and can therefore be easily lubricated using oil for engine lubrication.

Depending on the internal layout of the outboard motor, however, the intermediate speed reduction device discussed above cannot be disposed immediately below the engine, in which case it is conceivable to dispose the intermediate speed reduction device on an intermediate portion of the drive shaft. Since lubrication using engine oil is difficult in such an arrangement, it has been impossible to dispose the intermediate speed reduction device on an intermediate portion of the drive shaft.

SUMMARY OF THE INVENTION

In view of the problems described above, preferred embodiments of the present invention provide an oil supply device for an outboard motor in which an intermediate speed reduction device is mounted on a drive shaft and can be lubricated sufficiently in a simple and compact arrangement.

According to a preferred embodiment of the present invention, in an outboard motor having an engine installed above a casing with a crankshaft extending vertically, a drive shaft journaled vertically inside the casing, a propeller shaft journaled in a lower portion of the casing, and an intermediate speed reduction device provided on the drive shaft, wherein rotation of the crankshaft is transmitted via the drive shaft to the propeller shaft; an oil supply device is arranged to supply the intermediate speed reduction device with oil for lubrication around the propeller shaft.

The casing preferably includes a lower case supporting the propeller shaft and an upper case connected above the lower case, the intermediate speed reduction device is disposed above the lower case, and the oil supply device includes an oil guide passage arranged to communicate between an inside of the intermediate speed reduction device and a portion of the lower case around the propeller shaft.

The oil supply device preferably includes an axial oil passage provided along an axis of at least one of the drive shaft and the propeller shaft.

The oil supply device preferably includes an intersecting oil passage arranged to intersect the axial oil passage provided in the at least one of the drive shaft and the propeller shaft.

An axial extension of the intersecting oil passage provided in the propeller shaft preferably substantially coincides with an axial extension of the axial oil passage provided in the drive shaft when the intersecting oil passage is in a vertical direction as the propeller shaft rotates.

The oil guide passage is preferably arranged such that its lower end portion extends vertically in a drive shaft retention hole in which the drive shaft is inserted, with a lower end opening of the oil guide passage facing a discharge port of the intersecting oil passage provided in the drive shaft.

The intermediate speed reduction device preferably includes a planetary gear device including an inner gear positioned centrally inside a housing, an outer gear provided around the inner gear, and a plurality of intermediate gears provided between the inner gear and the outer gear, and a gear carrier arranged to retain the intermediate gear, wherein the oil guide passage communicates with the housing to guide oil to an area around the intermediate gears.

The oil supply device preferably includes an oil return passage arranged to communicate between the inside of the housing and an oil reservoir provided in the lower case.

The oil return passage is preferably provided in the housing, and a detachable drain plug is preferably provided at an upper portion of the oil return passage.

The drain plug is preferably located forwardly of the drive shaft with respect to a traveling direction of a boat on which the outboard motor is mounted.

The intermediate speed reduction device mounted on the drive shaft can be sufficiently lubricated with oil for lubrication around the propeller shaft.

The intermediate speed reduction device can be supplied with oil for lubrication around the propeller shaft through only existing components, thereby achieving a significantly simple and compact arrangement.

The oil supplied to the center of the intermediate speed reduction device is preferably spread to the outer periphery of the intermediate speed reduction device by centrifugal force, thereby sufficiently lubricating the intermediate speed reduction device in a simple arrangement.

The oil supplied to the intermediate speed reduction device is reliably circulated to the bottom of the casing via the oil return passage. Therefore, the intermediate speed reduction device can be lubricated sufficiently.

Air inside the intermediate speed reduction device can be reliably released from the oil return passage by removing the drain plug while replenishing the oil.

Thus, excessive oil flowing out of the oil return passage with air hardly adheres to the outer surface of the outboard motor by replenishing oil with the outboard motor tilted and the drain plug removed.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Preferred embodiments of the present invention will be described hereinafter with reference to FIGS. 1 to 4.

Figure 1:
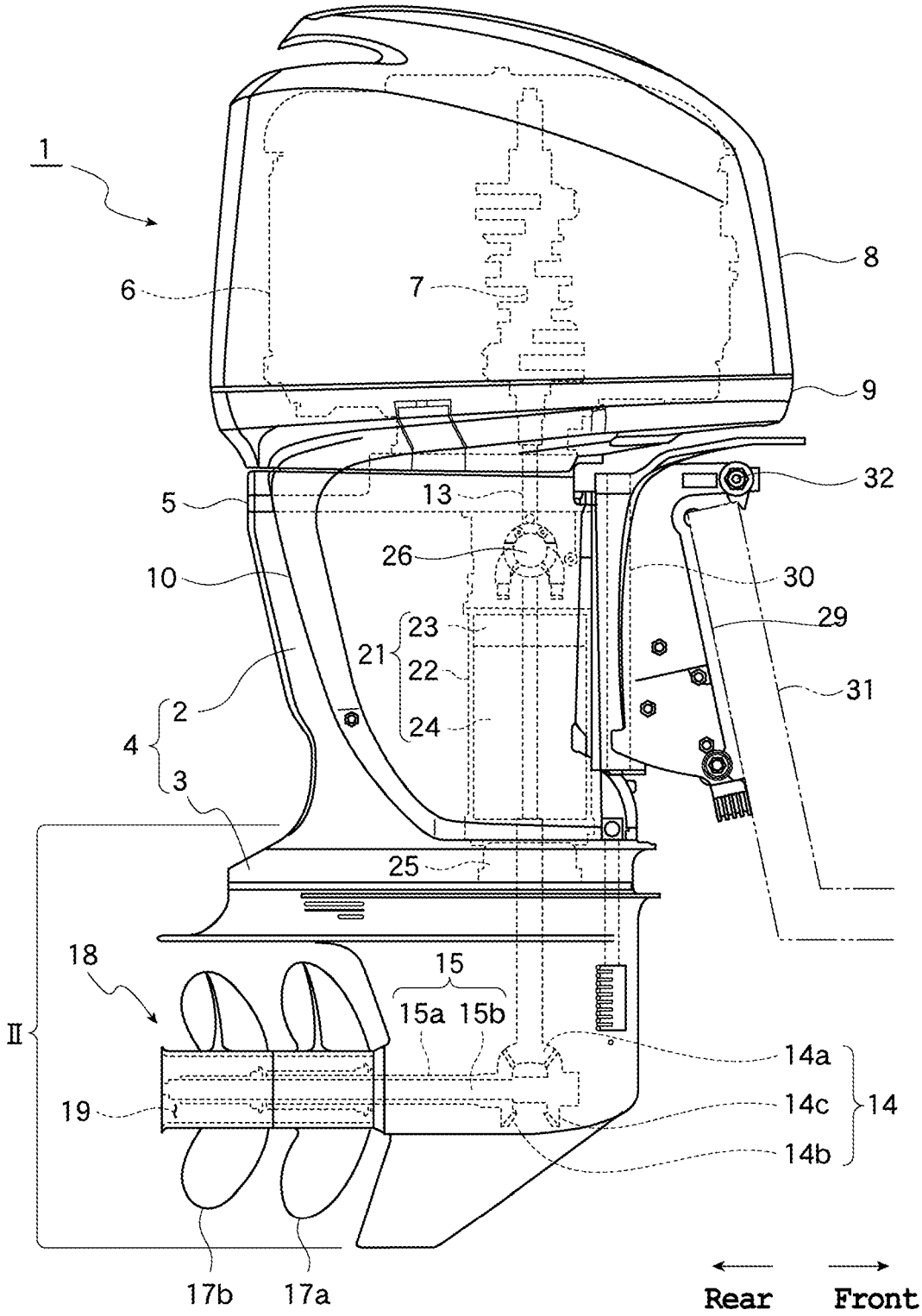
FIG. 1 is a right side view of an outboard motor in accordance with a preferred embodiment of the present invention.

FIG. 1 is a right side view of an outboard motor in accordance with a preferred embodiment of the present invention, with the right side of the drawing indicating the forward direction of the boat. An outboard motor 1 includes a casing 4 including an upper case 2 and a lower case 3 provided therebelow, and an engine 6 installed above the casing 4 via a generally flat mounting plate 5. The engine 6 is preferably a water-cooled engine with six cylinders in a V configuration, for example, and is placed on the mounting plate 5 with a crankshaft 7 extending vertically. The engine 6 is covered by an upper cover 8 and a lower cover 9 which are removable. The right and left sides of the upper case 2 are covered by a side cover 10 which is also removable.

Figure 2:
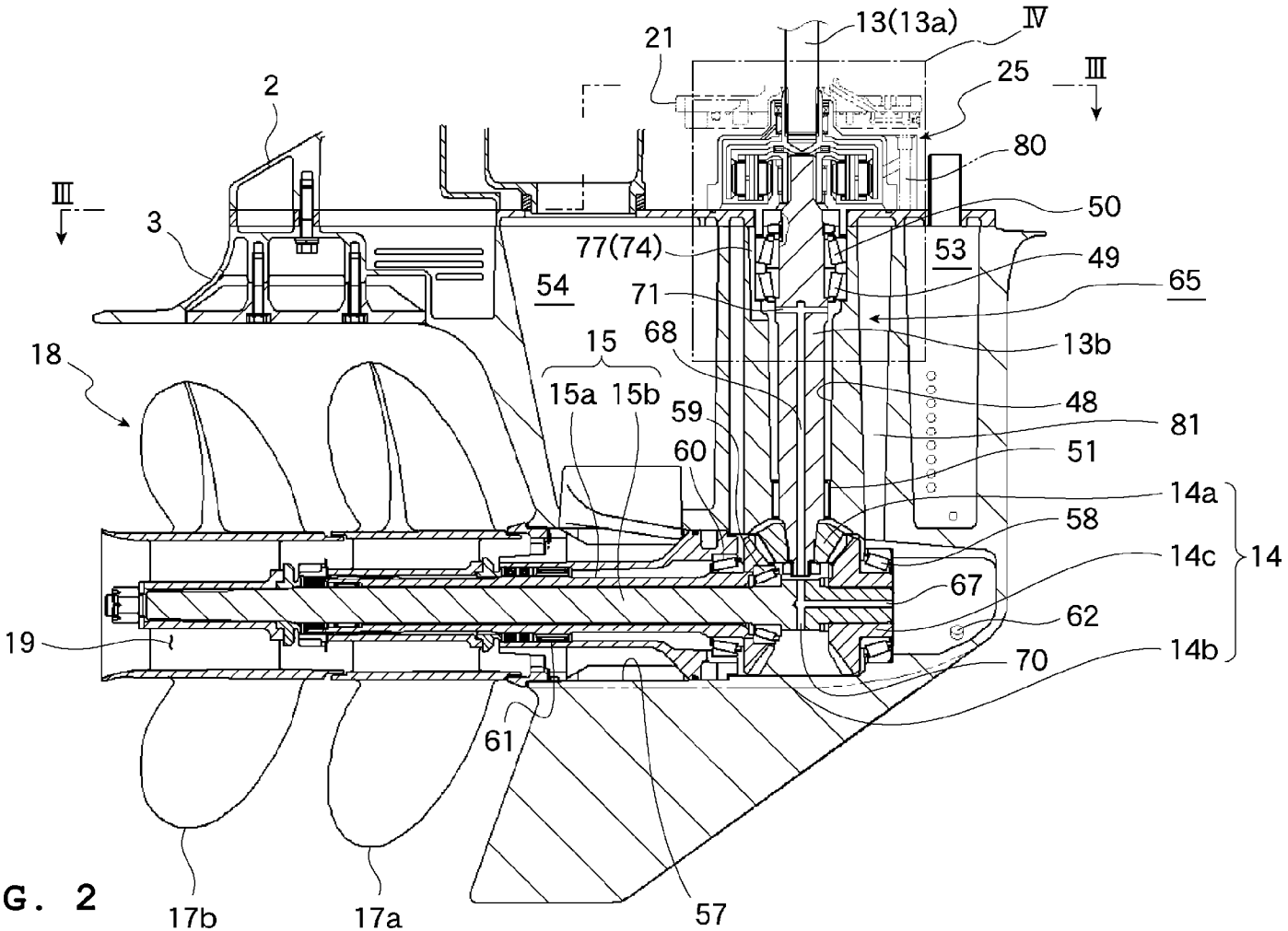
FIG. 2 is an enlarged vertical cross-sectional view of part II of FIG. 1 in accordance with a preferred embodiment of the present invention.

A drive shaft 13 is journaled vertically inside the casing 4. The drive shaft 13 is divided into a plurality of sections in the axial direction. The uppermost end is preferably spline-fitted to the lower end of the crankshaft 7 of the engine 6. The lowermost end reaches the inside of the lowercase 3 as shown in FIG. 2, and is connected via a bevel gear mechanism 14 to a propeller shaft 15 journaled horizontally inside the lower case 3.

The propeller shaft 15 is preferably a double rotary shaft including an outer shaft 15*a* and an inner shaft 15*b* assembled coaxially. A drive bevel gear 14*a* of the bevel gear mechanism 14 rotates together with the drive shaft 13 (13*b*). A driven bevel gear 14*b* rotates together with the outer shaft 15*a*. A driven bevel gear 14*c* rotates together with the inner shaft 15*b*. Since the drive bevel gear 14*a* has fewer teeth than those of the driven bevel gears 14*b* and 14*c*, the rotation of the drive shaft 13 is reduced before being transmitted to the propeller shaft 15.

A first propeller 17*a* is fixed to the outer shaft 15*a*. A second propeller 17*b* is fixed to the inner shaft 15*b*. These components define a counter-rotating propeller mechanism 18. An exhaust passage 19 is formed within the axial portions of the first propeller 17*a* and the second propeller 17*b*.

A transmission device 21 is provided inside the casing 4 (upper case 2). The transmission device 21 is mounted on the drive shaft 13, and includes a transmission case 22 as an outer shell, and a gear shift planetary gear mechanism 23 and a forward/reverse switching device 24 housed inside the transmission case 22. An intermediate speed reduction device 25 is provided immediately below the transmission device 21 and above the lower case 3. Reference numeral 26 denotes a water pump.

A clamp bracket 29 is provided at the front of the casing 4 via a steering shaft 30, and fixed to a stern (transom) 31 of the boat. The boat can be steered by turning the outboard motor 1 to the left and the right about the steering shaft 30. When the boat is to be moored, for example, the entire outboard motor 1 can be swung upward about a tilt shaft 32, which is provided at the front upper end of the clamp bracket 29, so as to be tilted up above the water level.

When the engine 6 is started, the rotation of the crankshaft 7 is transmitted to the drive shaft 13. The rotation of the drive shaft 13 is changed in terms of speed and/or direction by the transmission device 21, reduced by the intermediate speed reduction device 25 and the bevel gear mechanism 14, and then transmitted to the propeller shaft 15. This allows the outer shaft 15*a* and the first propeller 17*a*, and the inner shaft 15*b* and the second propeller 17*b*, to rotate on the propeller shaft 15 in opposite directions to each other, thereby generating a large propulsive force.

Figure 3:
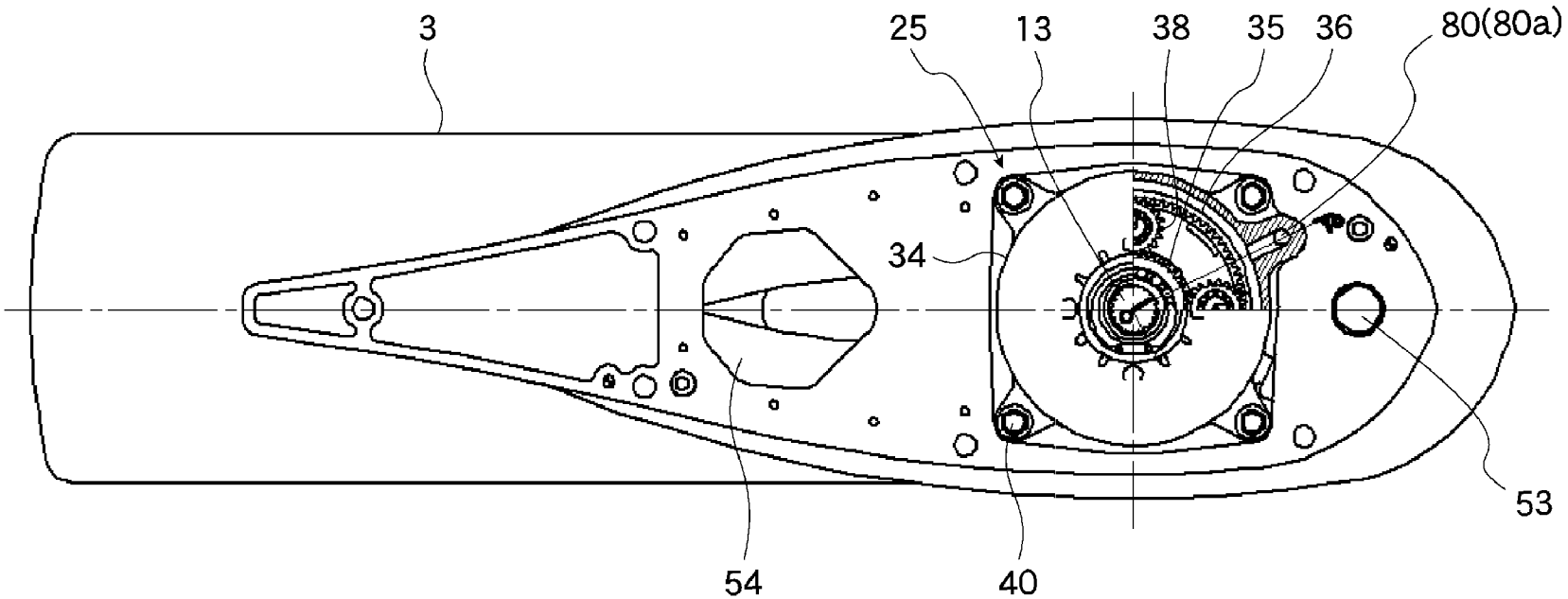
FIG. 3 is a plan view taken along the line III-III of FIG. 2 in accordance with a preferred embodiment of the present invention.
Figure 4:
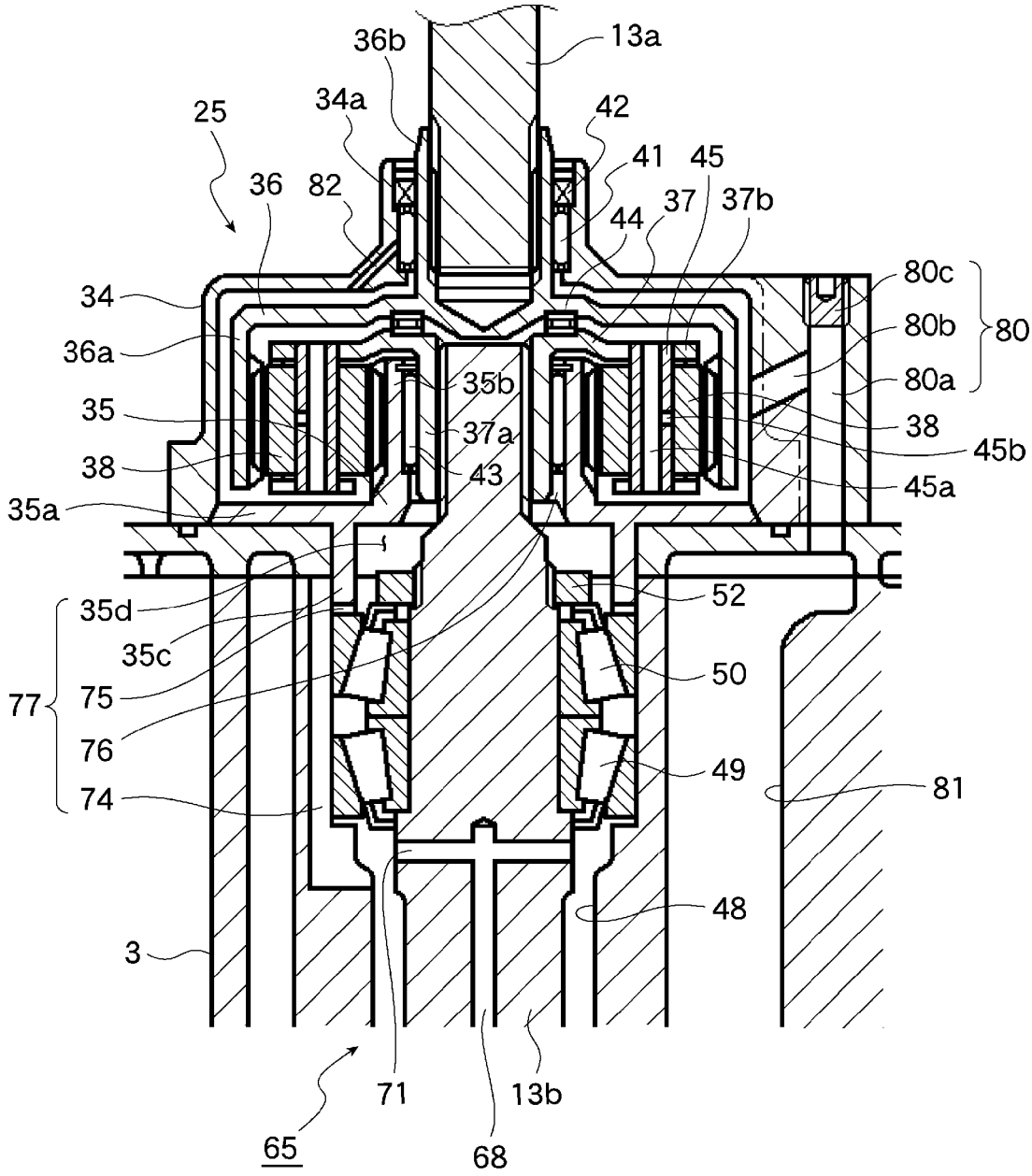
FIG. 4 is an enlarged vertical cross-sectional view of part IV of FIG. 2 in accordance with a preferred embodiment of the present invention.

As shown in FIGS. 3 and 4, the intermediate speed reduction device 25 preferably includes a planetary gear device including a housing 34 as an outer shell, and components housed inside the housing 34 such as an inner gear 35, an outer gear 36, a gear carrier 37, and an intermediate gear 38. The drive shaft 13 is split inside the intermediate speed reduction device 25 into an upper drive shaft 13*a* and a lower drive shaft 13*b*.

The housing 34 preferably has the shape of a cup opening downward. The housing 34 is fixed to the upper surface of the lower case 3 in a liquid sealed manner preferably by four bolts 40, for example. A cylindrical bearing sleeve 34*a* extending upward is provided at the top center of the housing 34.

The inner gear 35 has outer teeth, and is fixed centrally inside the housing 34. A disc-shaped flange 35*a* is formed integrally with the lower end of the inner gear 35, and serves as the bottom of the housing 34. A cylindrical support sleeve 35*b* extending upward is formed at the center of the inner gear 35. Gear teeth are formed on the outer peripheral surface of the support sleeve 35*b*. A fitting sleeve 35*c* is formed on the lower surface of the flange 35*a* to tightly fit the lower case 3.

The outer gear 36 has inner teeth surrounding the inner gear 35. The outer gear 36 preferably has the shape of a cup opening downward, with gear teeth formed on the inner side of an outer peripheral wall 36*a*. A needle bearing 41 and an oil seal 42 are interposed between the outer periphery of a cylindrical boss 36*b*, which is provided at the top center of the outer gear 36, and the inner periphery of the bearing sleeve 34*a* of the housing 34. The inner periphery of the boss 36*b* is preferably spline-fitted to the lower end of the upper drive shaft 13*a*.

The inner periphery of a cylindrical boss 37*a*, which is preferably located substantially at the center of the gear carrier 37, is preferably spline-fitted to the upper end of the lower drive shaft 13*b*. A needle bearing 43 is interposed between the outer periphery of the boss 37*a* and the inner periphery of the support sleeve 35*b* of the inner gear 35. A thrust bearing 44 is interposed between the upper surface of the gear carrier 37 and the outer gear 36.

The gear carrier 37 preferably includes four gear support arms 37*b*, for example. A gear shaft 45 extends vertically downward from each gear support arm 37*b*, and rotatably journals an intermediate gear 38 thereon, totaling four intermediate gears 38, for example. Outer teeth of the intermediate gears 38 mesh with the outer teeth of the inner gear 35 and the inner teeth of the outer gear 36. The gear shafts 45 are hollow with a hollow portion 45*a* and an oil feed hole 45*b* drilled therethrough.

In the thus configured intermediate speed reduction device 25, when the upper drive shaft 13*a* rotates, the outer gear 36 also rotates together therewith, which causes the four intermediate gears 38 to revolve around the inner gear 35 while rotating their own axes between the inner teeth of the outer gear 36 which is rotating and the outer teeth of the inner gear 35 which is fixed. This drives the gear carrier 37 to rotate, allowing the lower drive shaft 13*b* to rotate. The rotational direction of the lower drive shaft 13*b* is the same as that of the upper drive shaft 13*a*. The rotational speed of the lower drive shaft 13*b* is reduced to half that of the upper drive shaft 13*a*.

The lower drive shaft 13*b* is inserted into a drive shaft retention hole 48 vertically extending inside the lower case 3, and rotatably supported by a pair of conical roller bearings 49 and 50, which are fitted into the upper end of the drive shaft retention hole 48, and a needle bearing 51, which is fitted into the lower end of the drive shaft retention hole 48. In FIG. 4, reference numeral 52 denotes a locknut for the conical roller bearing 50. A water intake passage 53 for taking in water from outside for use as cooling water and a final exhaust expansion chamber 54 are defined in the front and the rear of the drive shaft retention hole 48, respectively (see FIG. 2).

On the other hand, the propeller shaft 15 is inserted, together with the driven bevel gears 14*b* and 14*c*, into a propeller shaft retention hole 57 formed horizontally inside the lower case 3, and rotatably supported preferably by three conical roller bearings 58, 59, and 60, which are fitted near the front end and intermediate portions of the propeller shaft retention hole 57, and a needle bearing 61, which is fitted into the rear end of the propeller shaft retention hole 57.

Lubrication oil is housed inside the propeller shaft retention hole 57 for lubrication around the propeller shaft 15 as a double rotary shaft and the bevel gear mechanism 14. An oil filling hole 62 is provided near the front bottom of the lower case 3, allowing oil to be filled into and discharged from the propeller shaft retention hole 57.

An oil supply device 65 is arranged to supply the intermediate speed reduction device 25 with oil reserved in the propeller shaft retention hole 57. The oil supply device 65 is configured as described below.

The inner shaft 15*b*, composing the propeller shaft 15, and the lower drive shaft 13*b*, composing the drive shaft 13, respectively include axial oil passages 67 and 68 and intersecting oil passages 70 and 71, which define oil supply devices.

The axial oil passage 67 is arranged to extend rearward along the axis of the inner shaft 15*b* from the front end thereof to a central position at which the driven bevel gears 14*b* and 14*c* face each other, that is, a position at which the axial oil passage 67 perpendicularly or substantially perpendicularly intersects the central axis of the lower drive shaft 13*b*. The intersecting oil passage 70 is provided near the rear end of the axial oil passage 67 so as to perpendicularly or substantially perpendicularly intersect it. The axial oil passage 67 and the intersecting oil passage 70 define a substantially T-shaped configuration.

The axial oil passage 68 is arranged to extend upward along the axis of the lower drive shaft 13*b* from the lower end thereof to a position in the vicinity of the intermediate speed reduction device 25, for example to the height immediately below the conical roller bearing 49. The intersecting oil passage 71 is provided near the upper end of the axial oil passage 68 so as to perpendicularly or substantially perpendicularly intersect it. The axial oil passage 68 and the intersecting oil passage 71 also define a substantially T-shaped configuration.

The axial oil passage 68 and the intersecting oil passage 70 are arranged such that when the inner shaft 15*b* has rotated to a position at which the intersecting oil passage 70 is directed vertically (the state of FIG. 2), the axial extensions of the intersecting oil passage 70 and the axial oil passage 68 coincide with each other and the openings of the intersecting oil passage 70 and axial oil passage 68 face each other in close proximity with a slight gap of several millimeters therebetween, for example. The axial extensions of the intersecting oil passage 70 and the axial oil passage 68 may not precisely coincide with each other, and there may be a slight deviation of several millimeters therebetween, for example. It is sufficient if oil spouted from the intersecting oil passage 70 flows into the axial oil passage 68 as discussed below.

The drive shaft retention hole 48 of the lower case 3 is provided with an oil guide groove 74. The oil guide groove 74 extends vertically in the drive shaft retention hole 48 as a vertical groove formed in a portion thereof surrounding the conical roller bearings 49 and 50. The lower end opening of the oil guide groove 74 opens into the drive shaft retention hole 48 immediately below the conical roller bearing 49 and at such a height that it faces the discharge port of the intersecting oil passage 71 formed in the lower drive shaft 13*b*. The upper end of the oil guide groove 74 opens in a mating surface with the upper case 2.

As shown in FIG. 4, the fitting sleeve 35*c* on the lower surface of the inner gear 35 of the intermediate speed reduction device 25 is tightly fitted into the upper end opening of the drive shaft retention hole 48. Between the lower end of the fitting sleeve 35*c* and the upper surface of the conical roller bearing 50 is formed a slight gap passage 75, which communicates with a space 35*d* on the inner peripheral side of the fitting sleeve 35*c*. An oil passage 76 is formed between the inner gear 35 (35*b*) and the gear carrier 37 (37*a*). The oil passage 76 communicates with an area near the needle bearing 43.

The oil guide groove 74, the gap passage 75, the space 35*d*, and the oil passage 76 described above define an oil guide passage 77, also referred to as an oil supply device. The oil guide passage 77 is arranged to communicate between the inside of the intermediate speed reduction device 25 and the space in the lower case 3 around the propeller shaft 15 (the propeller shaft retention hole 57).

On the other hand, the housing 34 of the intermediate speed reduction device 25 is provided with an oil return passage 80 including a vertical passage 80*a* located forwardly of the drive shaft 13, for example, at the front left thereof, with respect to the traveling direction of the boat, and a horizontal passage 80*b* for communication between an intermediate portion of the vertical passage 80*a* and the inside of the housing 34. The upper end opening of the vertical passage 80*a* is blocked by a drain plug 80*c* in a liquid sealed manner. Accordingly, the drain plug 80*c* is also disposed forwardly of the drive shaft 13 with respect to the traveling direction of the boat.

The vertical passage 80*a* communicates via a vertical passage way 81, which is formed inside the lower case 3, with the propeller shaft retention hole 57 as an oil reservoir. This allows communication between the inside of the housing 34 and the propeller shaft retention hole 57 via the oil return passage 80 and the vertical passageway 81. The bearing sleeve 34*a* of the housing 34 is provided with an oil passage 82 to supply the needle bearing 41 with oil inside the housing 34.

The oil supply device 65 preferably includes the axial oil passages 67 and 68, the intersecting oil passages 70 and 71, the oil guide passage 77, and the oil return passage 80.

When the engine 6 of the outboard motor 1 is started so as to rotate the lower drive shaft 13*b* of the drive shaft 13, the oil supply device 65 supplies the intermediate speed reduction device 25 with oil reserved in the propeller shaft retention hole 57.

That is, oil reserved in the propeller shaft retention hole 57 naturally flows into the axial oil passage 67 provided in the inner shaft 15*b* of the propeller shaft 15, and oil inside the axial oil passage 67 is spouted from the intersecting oil passage 70 by centrifugal force as the inner shaft 15*b* rotates. The oil spouted splashes radially of the inner shaft 15*b*. Oil in the propeller shaft retention hole 57 continuously flows into the axial oil passage 67.

The axial oil passage 68 in the lower drive shaft 13*b* is positioned in the vicinity of the intersecting oil passage 70, such that when the intersecting oil passage 70 is directed vertically, the intersecting oil passage 70 and the axial oil passage 68 are aligned along a line and the openings of the intersecting oil passage 70 and the axial oil passage 68 face each other in close proximity. Therefore, a portion of the oil spouted from the intersecting oil passage 70 flows into the axial oil passage 68.

The oil having flowed into the axial oil passage 68 rises in the axial oil passage 68, and is spouted from the opening of the intersecting oil passage 71 by centrifugal force of the lower drive shaft 13*b* that is rotating. The oil then flows into the lower end opening of the oil guide groove 74 (the oil guide passage 77), which is disposed at the same height as the opening of the intersecting oil passage 71. The oil guide groove 74 is arranged in a wall of the lower case 3 in such a manner as to detour around the conical roller bearings 49 and 50, which journal the upper portion of the lower drive shaft 13*b*. Thereafter, the oil flows from the gap passage 75, which is located above the conical roller bearings 49 and 50, through the space 35*d* around the lower drive shaft 13*b*, to the oil passage 76, which communicates between the inside of the lower case 3 and the inside of the intermediate speed reduction device 25. The oil is further guided between the rollers of the needle bearing 43 into the intermediate speed reduction device 25.

The oil passage 76 including the oil guide passage 77 communicates with an area near the needle bearing 43 located in the center of the intermediate speed reduction device 25. Therefore, the oil guided into the intermediate speed reduction device 25 is distributed around the intermediate gear 38 and spread over to the outer periphery of the intermediate speed reduction device 25 by centrifugal force, thereby sufficiently lubricating the entire inside of the intermediate speed reduction device 25. The oil also flows out of the hollow portion 45*a* and the oil feed hole 45*b* of the gear shaft 45 journaling the intermediate gear 38, thereby lubricating the journal portion and the tooth tips of the intermediate gear 38.

The oil having lubricated the inside of the intermediate speed reduction device 25 is reliably circulated to the propeller shaft retention hole 57 via the horizontal passage 80*b* and the vertical passage 80*a* of the oil return passage 80 and the vertical passageway 81. Therefore, the intermediate speed reduction device 25 can be lubricated reliably and continuously. The horizontal passage 80*b* is arranged to be inclined such that the opening (outlet) on the side of the vertical passage 80*a* is higher than the opening (inlet) on the side of the inside of the intermediate speed reduction device 25. Thus, a hole as the horizontal passage 80*b* can be processed easily. In addition, it is possible to adjust the amount of oil to be reserved inside the intermediate speed reduction device 25 by adjusting the diameter and the inclination angle of the passage.

According to the oil supply device 65 in accordance with this preferred embodiment, the intermediate speed reduction device 25 can be lubricated sufficiently by supplying the intermediate speed reduction device 25 with lubricating oil around the propeller shaft 15 in a simple and compact arrangement, by using only existing parts such as the drive shaft 13 and the propeller shaft 15 and with no new parts added.

The oil reserved in the propeller shaft retention hole 57 is discharged and replenished from the oil filling hole 62 formed near the front bottom of the lower case 3. By removing the drain plug 80*c* of the vertical passage 80*a* at this time, the oil can be discharged with an improved efficiency, and air in the intermediate speed reduction device 25 can be reliably released from the vertical passage 80*a* while refilling the oil.

The vertical passage 80*a* and the drain plug 80*c* are disposed forwardly of the drive shaft 13 with respect to the traveling direction of the boat. Therefore, by replenishing oil from the oil filling hole 62 with the outboard motor 1 tilted and the drain plug 80*c* removed, excessive oil flowing out of the vertical passage 80*a* with air hardly adheres to the outer surface of the lower case 3 or the like.

In the outboard motor 1, the rotation of the lower drive shaft 13*b* is reduced by the bevel gear mechanism 14 before being transmitted to the inner shaft 15*b*. Therefore, the rotational speed of the lower drive shaft 13*b* is higher than that of the inner shaft 15*b*, and hence the centrifugal force applied to the intersecting oil passage 71 is larger than that applied to the intersecting oil passage 70. Thus, the force of the lower drive shaft 13*b* to draw in and spout oil is larger than that of the inner shaft 15*b* (on the condition that the diameters of the respective oil passages are the same as each other), which is advantageous in this preferred embodiment because the shaft 13*b* must supply oil to a position higher than the shaft 15*b* does.

In the oil supply device 65 in accordance with this preferred embodiment, the intersecting oil passages 70 and 71 are formed in respective portions of the lower drive shaft 13*b* and the inner shaft 15*b* with a large outer diameter, which increases the lengths of the intersecting oil passages 70 and 71. This increases the centrifugal force applied to oil in the intersecting oil passages 70 and 71 and hence the amount of oil to be spouted (oil spouting pressure), thereby improving the lubrication performance.

In the oil supply device 65 in accordance with this preferred embodiment, the intersecting oil passages 70 and 71 are respectively arranged to intersect the axial oil passages 67 and 68 perpendicularly (at an angle of about 90 degrees, for example). However, the intersecting oil passages 70 and 71 may be respectively arranged at any angle with respect to the axial oil passages 67 and 68. A plurality of intersecting oil passages 70, or 71, may be provided for a single axial oil passage 67, or 68.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An outboard motor comprising:

a casing including an engine including a vertically extending crankshaft, a drive shaft journaled vertically inside the casing, a propeller shaft journaled in a lower portion of the casing, and an intermediate speed reduction device arranged on the drive shaft such that rotation of the crankshaft is transmitted via the drive shaft to the propeller shaft; and an oil supply device arranged to circulate oil between the intermediate speed reduction device and the propeller shaft.

2. The outboard motor according to claim 1, wherein the casing includes a lower case arranged to support the propeller shaft and an upper case connected above the lower case, the intermediate speed reduction device is disposed above the lower case, and the oil supply device includes an oil guide passage arranged to communicate between an inside of the intermediate speed reduction device and a portion of the lower case around the propeller shaft.

3. The outboard motor according to claim 2, wherein the intermediate speed reduction device includes a planetary gear device including an inner gear positioned centrally inside a housing, an outer gear arranged around the inner gear, and a plurality of intermediate gears provided between the inner gear and the outer gear, and a gear carrier arranged to retain the plurality of intermediate gears, and the oil guide passage communicates with the housing to guide oil to an area around the plurality of intermediate gears.

4. The outboard motor according to claim 3, wherein the oil supply device includes an oil return passage arranged to communicate between the inside of the housing and an oil reservoir provided in the lower case.

5. The outboard motor according to claim 4, wherein the oil return passage is provided in the housing, and a detachable drain plug is provided at an upper portion of the oil return passage.

6. The outboard motor according to claim 5, wherein the drain plug is disposed forwardly of the drive shaft with respect to a traveling direction of a boat on which the outboard motor is mounted.

7. The outboard motor according to claim 5, further comprising a transmission including a gearshift planetary gear mechanism, wherein the transmission is arranged in the casing above the intermediate speed reduction device.

8. The outboard motor according to claim 1, wherein the oil supply device includes an axial oil passage provided in at least one of the drive shaft and the propeller shaft.

9. The outboard motor according to claim 8, wherein the oil supply device includes an intersecting oil passage arranged to intersect the axial oil passage provided in the at least one of the drive shaft and the propeller shaft.

10. The outboard motor according to claim 9, wherein the intersecting oil passage is provided in the propeller shaft and the axial oil passage is provided in the drive shaft, and an axial extension of the intersecting oil passage substantially coincides with an axial extension of the axial oil passage when the intersecting oil passage is in a vertical orientation as the propeller shaft rotates.

11. The outboard motor according to claim 9, wherein the intersecting oil passage is provided in the drive shaft, the oil guide passage includes an oil guide groove arranged such that its lower end portion extends vertically in a drive shaft retention hole in which the drive shaft is inserted, and a lower end opening of the oil guide groove faces a discharge port of the intersecting oil passage.

* * * * *